US005590845A

United States Patent [19]

Nakagawa et al.

[11] Patent Number: 5,590,845

[45] Date of Patent: Jan. 7, 1997

[54] YARN END FINDING APPARATUS AND METHOD

[75] Inventors: Takashi Nakagawa, Uji; Yuji Todo, Nagaokakyo, both of Japan

[73] Assignee: Murata Kikai Kabushiki Kaisha, Kyoto, Japan

[21] Appl. No.: 310,071

[22] Filed: Sep. 22, 1994

[30] Foreign Application Priority Data

Sep. 24, 1993 [JP] Japan ..... 5-238305
Nov. 10, 1993 [JP] Japan ..... 5-281505

[51] Int. Cl.[6] ..... B65H 69/04

[52] U.S. Cl. ..... 242/35.6 E; 242/35.5 A

[58] Field of Search ..... 242/35.6 E, 35.5 R, 242/35.5 A

[56] References Cited

U.S. PATENT DOCUMENTS

| | | | |
|---|---|---|---|
| 3,236,464 | 2/1966 | Wey | 242/35.6 E |
| 3,728,550 | 4/1973 | Cleland, Jr. et al. | 242/35.6 E X |
| 4,619,416 | 10/1986 | Matsui et al. | 242/35.6 E X |
| 4,634,065 | 1/1987 | Kupper et al. | 242/35.6 E X |
| 4,660,780 | 4/1987 | Otoshima | 242/35.6 E |
| 4,673,138 | 6/1987 | Ichiba | 242/35.5 R |
| 4,858,836 | 8/1989 | Tone et al. | 242/35.6 E X |
| 4,901,931 | 2/1990 | Mista | 242/35.6 E X |
| 4,911,371 | 3/1990 | Mista | 242/35.6 E |
| 5,024,389 | 6/1991 | Grecksch et al. | 242/35.5 A |
| 5,056,725 | 10/1991 | Wirtz et al. | 242/35.6 E X |
| 5,106,027 | 4/1992 | Wirtz et al. | 242/35.6 E X |
| 5,106,032 | 4/1992 | Tanigawa | 242/35.5 R X |
| 5,282,581 | 2/1994 | Engelhardt et al. | 242/35.6 E |
| 5,288,030 | 2/1994 | Wirtz et al. | 242/35.6 E X |

FOREIGN PATENT DOCUMENTS

| | | | |
|---|---|---|---|
| 61-155171 | 7/1986 | Japan . | |
| 5-5746 | 1/1993 | Japan . | |
| 411648 | 11/1966 | Switzerland | 242/35.6 E |

*Primary Examiner*—Michael R. Mansen
*Attorney, Agent, or Firm*—Armstrong, Westerman, Hattori, McLeland & Naughton

[57] ABSTRACT

The yarn end finding apparatus includes an air current generating member and an air current control member for controlling an air current generated by the air current generating member in such a manner that the air current flows along the surface of yarn layers of a bobbin. The air current control member is disposed in a position either partially or totally surrounding the bobbin in order for the air current control member to be movable upward and with respect to the bobbin. The yarn end finding apparatus of the present invention is compact in structure so as to permit a yarn finding operation to be performed in a single location.

17 Claims, 8 Drawing Sheets

YARN END FINDING APPARATUS AND METHOD

BACKGROUND OF THE INVENTION

1. Field of the Invention

The present invention relates to a yarn end finding apparatus for finding a yarn end of a spinning bobbin or the like and then feeding the bobbin to a winder or the like.

2. Related Art Statement

When a spinning bobbin produced in a spinning frame is fed to each take-up unit of a winder, it is subjected to a yarn end finding operation so that its yarn end can be grasped easily.

In a conventional yarn end finding apparatus, as disclosed in Japanese Patent Laid Open No. 155171/86, bobbins are moved intermittently to a large number of stations by means of a rotary plate and bottom or top bunches of the bobbins are unwound successively, then an end portion of each unwound yarn is inserted into the hole of the associated bobbin to effect yarn end processing.

In the above conventional yarn end finding apparatus, however, since bobbins are moved by means of a rotary plate to effect yarn end finding, the apparatus is apt to become larger in size, and since both unwinding of top or bottom bunch and yarn end finding operation for an end portion of the unwound yarn are performed simultaneously, it is necessary to decide timing of the intermittent movement in conformity with the processing of lowest efficiency in the stations, so it is difficult to improve productivity. There is a further problem such that even in the event of failure of processing in an upstream-side station, for example even when unwinding of the top bunch cannot be effected, the yarn end finding operation is performed on the downstream side.

SUMMARY OF THE INVENTION

Accordingly, it is a first object of the present invention to solve the above-mentioned problems and provide a yarn end finding apparatus which is compact in structure and which permits a yarn end finding operation to be done positively in one place.

It is a second object of the present invention to provide a bobbin transport system which includes a yarn end finding apparatus whereby high efficiency of a yarn end finding operation can be attained.

According to the present invention, in order to achieve the above-mentioned objects, there is provided a yarn end finding apparatus including an air current generating means and an air current control member for controlling an air current generated by the air current generating means in such a manner that the air current flows along the surface of yarn layers of a bobbin, the air current control member being disposed in a surrounding position for part or the whole of the bobbin so as to be movable upward and downward.

According to the above construction, the air current is exerted strongly on the yarn layer surface of the bobbin and a yarn end is separated from the yarn layers by virtue of the air current. Thus, in that position it is possible to effect yarn end finding operation positively in a simple manner.

Furthermore, the yarn end finding apparatus may be provided with a yarn end detecting sensor for detecting a yarn end drawn out from a yarn layer of a bobbin, which acts to stop the advancing movement of the air current control member to a position surrounding a part or whole of a bobbin when the yarn end detecting sensor detects a yarn end. According to such construction, a yarn end finding operation can be speeded up. It is also preferable to provide a bobbin pressing means for holding a lower portion of a bobbin which is erected on a tray. A bobbin is not extracted from a tray if strong air current is applied, since the lower portion of the bobbin is held by the bobbin pressing means. Thus, the yarn end finding operation can be processed surely.

DETAILED DESCRIPTION OF PREFERRED EMBODIMENTS

An embodiment of the present invention will be described below in detail with reference to the accompanying drawings.

Figure 1A:
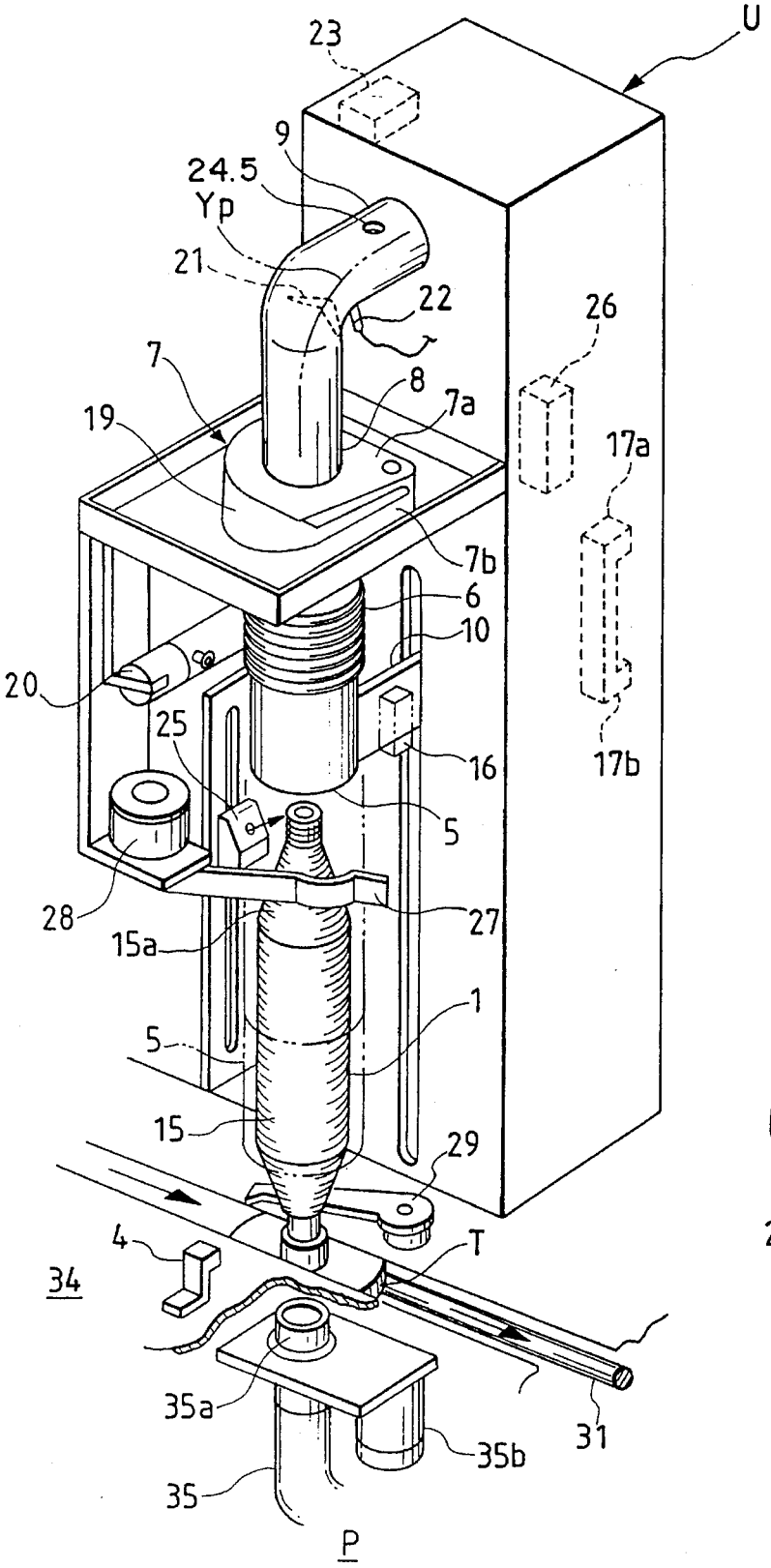
FIG. 1A is a perspective view illustrating an embodiment of a yarn end finding apparatus of the present invention.
Figure 2:
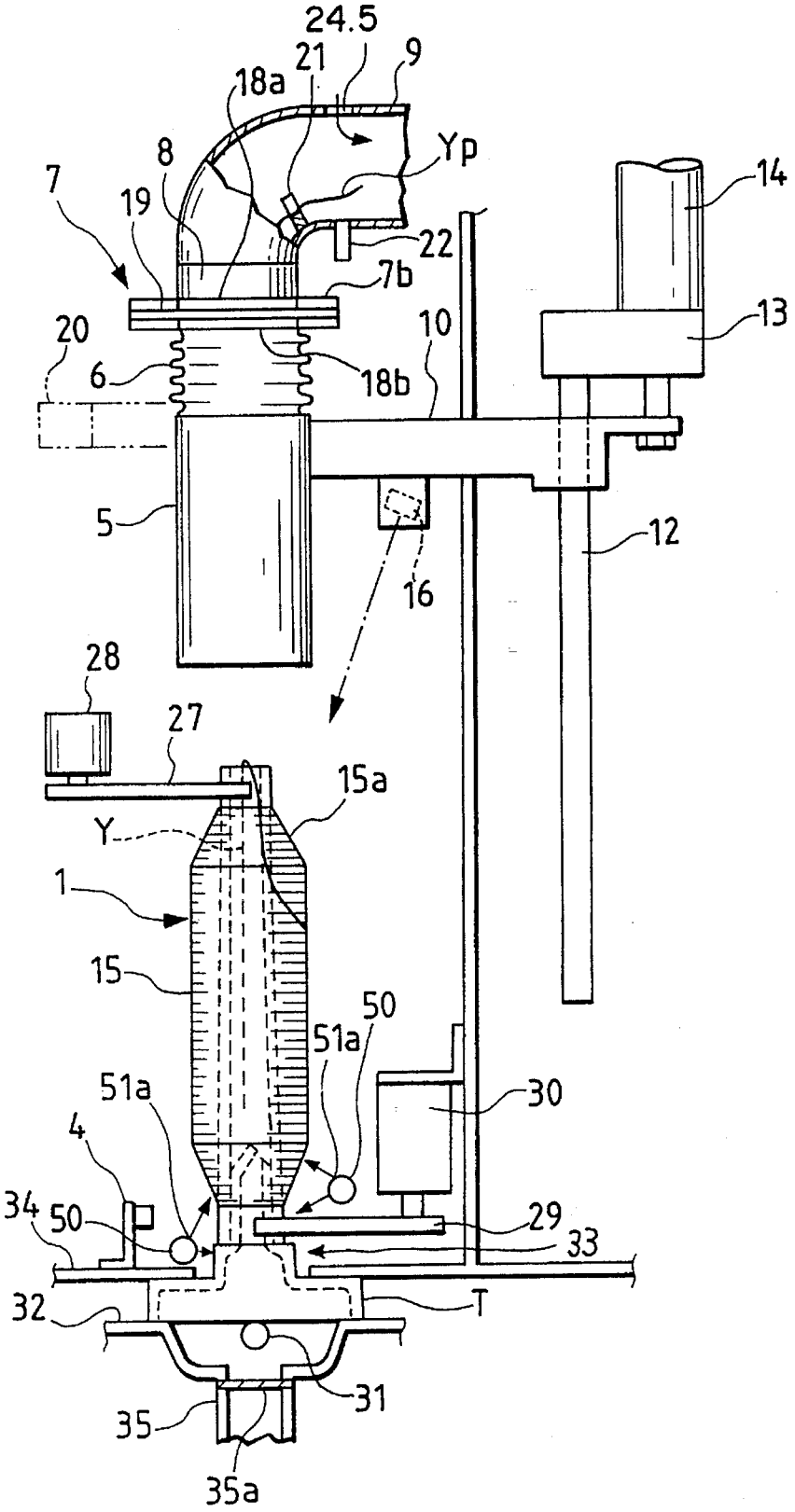
FIG. 2 is a sectional side view of FIG. 1A.

In FIGS. 1A and 2, the numeral 1 denotes a bobbin for yarn end finding. The bobbin 1 is conveyed along a yarn end finding conveyance path 2 while being carried upright on a conveyance tray T, and is stopped in a yarn end finding position P by means of a stopper (not shown).

On an upstream side of the conveyance path 2 with respect to the yarn end finding position P there is disposed a discriminator (not shown) for judging whether the bobbin is rewindable in a winder or not. A bobbin with only an extremely small amount of residual yarn thereon, as well as an empty bobbin and an empty tray, are judged to be not rewindable.

Near the bobbin stop position is disposed a tray sensor 4 for detecting the tray T.

A yarn end finding apparatus body U is mounted upright in corresponding relation to the yarn end finding position P. The apparatus body U has a cylinder 5 (an air current control member) being vertically movable in a position just above the bobbin 1 stopped in the yarn end finding position P. To the upper portion of the cylinder 5 is connected a bellows hose 6 capable of expansion and contraction, which hose 6 is in turn connected to a shutter-cutter 7. Further, to an outlet pipe 8 of the shutter-cutter 7 is connected a suction pipe 9 which is connected to an air current generating means.

An arm 10 is attached to the cylinder 5. The arm 10 extends through a slit 11 formed in the apparatus body U and is mounted vertically movably to a vertical guide rod 12 mounted within the body U. Further, a cylinder 14 for moving the arm 10 up and down is mounted on a fixing plate 13 for the rod 12.

The arm 10 is actuated by the cylinder 14 for vertical movement in accordance with ON-OFF operation of solenoid valves 17*a* and 17*b* which are for ascent and descent, respectively, whereby the cylinder 5 is moved up and down.

The shutter-cutter 7 is constructed as follows. Holes 18*a* and 18*b* for communication between the bellows hose 6 and the outlet pipe 8 are formed in upper and lower plates 7*a*, 7*b*, and there is provided a movable shutter 19 which opens and closes the holes 18*a* and 18*b* and which cuts the yarn passing through the holes 18*a* and 18*b* to a predetermined length. The movable shutter 19 is opened and closed by means of a rod 20*a* of a shutter actuator 20 (see FIG. 1C).

Figure 1B:
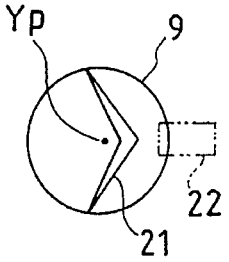
FIG. 1B is a sectional view of a part of the apparatus.
Figure 1C:
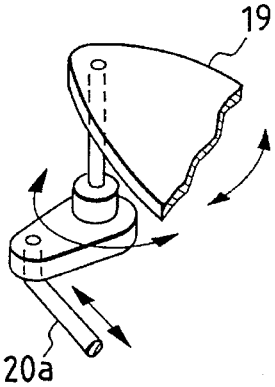
FIG. 1C is a perspective illustration showing a movement of a part of the apparatus.

As shown in FIG. 1B, a V-shaped guide 21 for guiding a sucked yarn end to a predetermined position is disposed on an in-corner side of a bent portion within the suction pipe 9, and a yarn end finding sensor 22 is disposed so as to be positioned in corresponding relation to a yarn path YP of the guide 21. Solenoid valves 17*a*, 17*b* for operating the cylinder 14 for vertical movement, and a solenoid valve 23 for the shutter-cutter which valve operates the shutter actuator 20 are actuated by the output of the sensor 22. A small hole 24.5 is so provided on an out-corner side of the bent portion of the suction pipe 9 that a yarn end cut by the shutter-cutter 7 is not retained in the suction pipe 9.

The yarn end finding apparatus body U is provided with a bunch removing blast nozzle 25 for removing a top bunch 24 located at the top of the bobbin 1 and is also provided with a solenoid valve 26 for blast which makes and breaks the supply of air for the blast nozzle 25. The blast nozzle 25 is used only for a bobbin having the top bunch 24 and not used for a bobbin having a bottom bunch.

Above the bobbin 1 is disposed a head pressing lever 27 for pressing onto the bobbin 1 the yarn which has been released from the bobbin and sucked into the suction pipe 9. The head pressing lever 27 is moved into abutment with and away from the head of the bobbin 1 by means of an actuator 28.

In the yarn end finding position P are disposed a bobbin pressing lever 29 for holding means of a bobbin and an actuator 30 for the lever, the bobbin pressing lever 29 pressing a lower yarn-free portion of the bobbin 1 to prevent the bobbin from coming off the tray T at the time of yarn end finding for the bobbin, particularly when a yarn of the bobbin 1 is released from the bobbin using the cylinder 5.

The conveyance path 2 for yarn end finding comprises a round belt 31 for conveyance of the tray T, bottom guide plates 32 disposed along both sides of the round belt 31 to bear and guide both sides of the bottom portion of the tray T, and upper guide plates 34 for restricting and guiding a peg portion 33 of the tray, as shown in FIG. 2. In the yarn end finding position P and below the tray conveyance path is disposed a suction pipe 35 for sucking into the bobbin 1 the cut yarn which has been cut a predetermined length by the shutter-cutter 7. The upper-end opening of the suction pipe 35 faces toward the underside center of the tray T located in the yarn end finding position P. In an appropriate position of the suction pipe 35 is provided a top opening suction shutter 35*a*, which is opened and closed by a solenoid 35*b*. In the yarn end finding position P, moreover, yarn blow-off nozzles 50 are disposed on the upper guide plates 34 and in both side positions with respect to the bobbin 1. Each nozzle 50 has two injection holes 51*a* for the injection of blast air obliquely upward and obliquely downward with respect to the bobbin 1. For example, a yarn portion hanging down from the yarn layers on the bobbin 1 is blown out of the bobbin pressing range of the bobbin pressing lever 29 by virtue of the blast air from the nozzle 50.

The yarn end finding operation will be described below.

Until when the tray T is conveyed to the yarn end finding position P along the conveyance path 2, it is judged whether the bobbin on the tray is re-windable in a winder or not, that is, whether yarn end finding is necessary or not, by means of the discriminator (not shown). In the case where yarn end finding is not necessary, for example in the case of a bobbin with only a very small amount of yarn remaining thereon, or an empty bobbin or an empty tray without a bobbin carried thereon, the yarn end finding apparatus does not perform yarn end finding and the bobbin not requiring yarn end finding passes the yarn end finding apparatus together with the tray T. On the other hand, where yarn end finding is required, for example in the case of a full-, partial- or skinny-bobbin, the following yarn end finding operation is performed. When the tray T has been conveyed up to the yarn end finding position P, it is stopped in that position by the stopper (not shown). Upon detection of the tray T by the tray sensor 4, blast air is ejected from the yarn blow-off nozzles 50, then the bobbin presser lever 29 (solenoid 28) operates, so that the lower portion of the bobbin 1 is pressed by the front end portion of the lever 29. In this state, there is no fear of the bobbin 1 coming off the tray T even if a suction force is exerted thereon, as will be described later. Since air is ejected from the nozzles 50 before the bobbin 1 is pressed by the lever 29, it is possible to prevent a yarn end from being gripped between the lever 29 and the bobbin 1. Further, simultaneously with the operation of the lever 29, the actuator 20 operates, the shutter-cutter 7 opens, the suction pipe 9 and the cylinder 5 come into communication with each other, and an air current flowing toward the interior of the cylinder 5, namely a suction force, is created and rises along the yarn layer surface of the bobbin 1. Thus, there is generated an air current flowing toward the interior of the cylinder 5.

Subsequent operations are different between a bobbin having a bottom bunch and a bobbin having a top bunch, so the operation in the former case will first be described. In the case of a bottom bunch, a bottom bunch cutting station is provided on the upstream side of the yarn end finding position P.

When the shutter-cutter 7 has started operating, the cylinder 5 begins to move down after the lapse of a slight period of time. However, if during such slight period of time the yarn end finding sensor detects 22 that the yarn end of the bobbin 1 has been sucked into the suction pipe 9 through the cylinder 5, the cylinder 5 does not move down. As the cylinder 5 goes down, the cylinder and the bobbin 1 approach each other gradually, so that the air current working on the yarn layers of the bobbin is enhanced. If the yarn end is detected by the sensor 22 during the downward movement of the cylinder 5, the cylinder rises immediately. On the other hand, where the yarn end is not detected by the sensor 22, the cylinder 5 moves down to a position (lower end of the stroke) in which it surrounds substantially the whole of the bobbin 1. When the cylinder 5 reaches the lower end of the stroke, it then begins to move upward. If the yarn end is not detected by the sensor 22 until when the cylinder 5 reaches the upper end of the stroke, the cylinder again performs its descending motion. In the case where the yarn end is not detected by the sensor 22 even after the descent and ascent of the cylinder 5 have been repeated three times, the stopper (not shown) is released and the tray T is moved away from the yarn end finding position. The downward and upward motion of the cylinder 5 may be repeated once or four times or more. During the period between the time when the cylinder 5 starts ascending and the time when it starts descending next, the ejection of blast air from the yarn blow-off nozzles 50 is stopped. This can be done easily by reception of signals from the solenoid valves 17*a* and 17*b*.

When the yarn end is detected by the sensor 22 and the cylinder 5 rises and reaches its stroke upper end, this state is detected by means a sensor (not shown), whereupon the head pressing lever 27 operates, comes into abutment with the head portion of the bobbin 1, presses the yarn portion extending between the bobbin and the suction pipe 9, and stops the releasing of the yarn. The construction may be modified so that the head pressing lever 27 operates when the cylinder 5 has ascended to a predetermined height, not the upper end of the stroke, if only the interference between the cylinder 5 and the lever 27 is avoided. The solenoid 35*b* also operates simultaneously with the operation of the solenoid 28 and the top opening suction shutter 35*a* opens, so that a suction force is exerted toward the interior of the bobbin 1.

Thereafter, the actuator 20 operates to close the shutter-cutter 7, whereby the yarn extending from the bobbin 1 to the suction pipe 9 is cut by the shutter-cutter 7. The thus-cut yarn end from the bobbin 1 is sucked into the bobbin by the suction force of the suction pipe 35. In this case, since the distance from the bobbin 1 to the shutter-cutter 7 is set shorter than the length of the bobbin, the yarn end which has been sucked into the bobbin will never pass the tray T and extend up to the suction pipe 35.

Subsequently, the solenoid 28 operates, the head pressing lever 27 moves back to its original position, the bobbin pressing lever 29 returns to its original position, and the suction shutter 35*a* closes. Thereafter, the stopper which stops the tray T is released, so that the tray is moved away from the yarn end finding position P and is fed to a take-up unit of a winder through the conveyance path 2.

The following description is now provided about a bobbin having a top bunch. In this case, after operation of the shutter-cutter 7, blast air is ejected from the bunch removing blast nozzle 25 toward the bunch portion of the bobbin 1 for a predetermined time. Next, the cylinder 5 begins to go down, followed by the same operation as in the case of the bottom bunch.

As indicated by a dash-double dot line, a bobbin sensor 16 for detecting a chase portion 15*a* of yarn layers 15 of the bobbin 1 may be attached to the arm 10, and the cylinder 5 may be descended on the basis of a detected value provided from the sensor 16. In this case, the cylinder 5 is moved down until the sensor 16 detects the chase portion 15*a* independently of the detection made by the sensor 22. Thereafter, the cylinder 5 may be raised upon detection of yarn end by the sensor 22 or upon lapse of a predetermined time. It is desirable that such a method of lowering the cylinder 5 while looking at the chase portion 15*a* be applied to the case where the shape of the cylinder 5 conforms to the chase portion as in FIGS. 3B, 3C and 3D. It is preferable to provide an opening with the cylinder 5 so that the sensor 16 can detect the chase portion 15*a* through the cylinder 5.

In the embodiment mentioned above, when a yarn end is detected by the sensor 22, the cylinder 5 (a member for controlling an air current) is raised (retracted) and then the next operation (such as an operation of a shutter-cutter) is processed. However, the next operation may be started just after the yarn end is detected by the sensor 22 for detecting the yarn end finding. While, when a yarn end is detected by the sensor 22 for detecting yarn end finding, the cylinder 5 may be stopped and the shutter-cutter 7 may be operated at first, and the cylinder 5 may be raised thereafter. Because of the provision of means for inserting a yarn end into a hole of the bobbin 1, it may be possible to provide means for winding the yarn end around the head portion of the bobbin 1 or means for fixing the yarn end on the yarn layer of the bobbin 1. The suction pipe 9 and the cylinder 5 may be disposed continuously or separately. The bobbin pressing member may be a plunger and the like which advances to or is retracted from the lower end portion of a bobbin by means of a solenoid other than the swingable lever.

FIGS. 3A–3E shows examples of the cylinder 5 used in the present invention.

As bobbins 1 to be subjected to yarn end finding there are: a full-loaded bobbin from the spinning frame, a partial bobbin whose yarn has been broken in a take-up unit and which has been discharged because of being incapable of yarn joining, and a bobbin which has been conveyed back because of failure in yarn end finding. Some bobbins have a top or bottom bunch at the winding end of yarn. It is more desirable to select a suitable shape of the cylinder 5 according to the kind and shape of the bobbin 1. It is preferable that the spacing between the inner surface of the cylinder 5 and the yarn layer surface of the bobbin 1 be made as small as possible (10 mm or less).

Figure 3A:
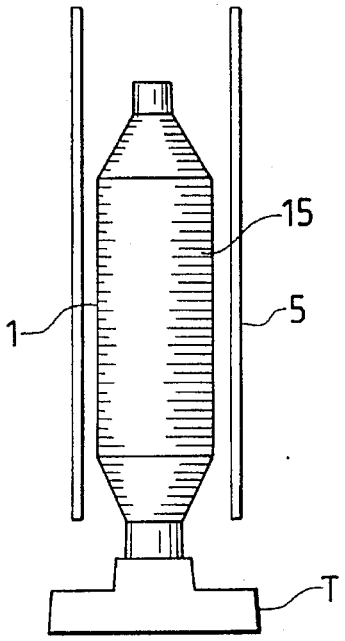
FIGS. 3A to 3E show various examples of cylinders diagrammatically.
Figure 3B:
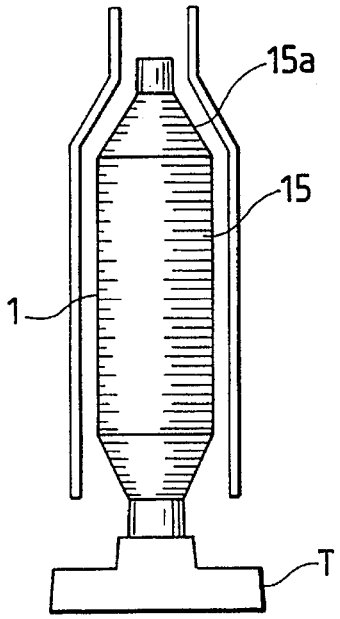
Figure 3C:
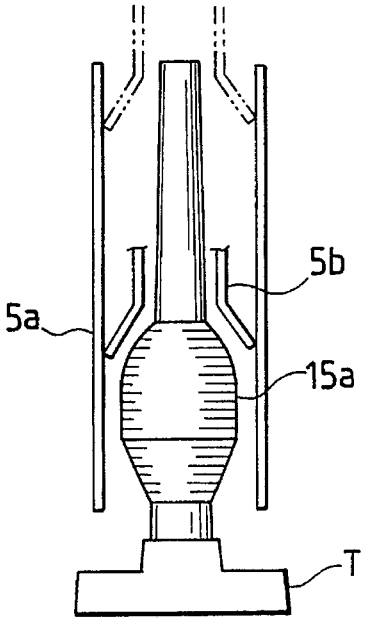
Figure 3D:
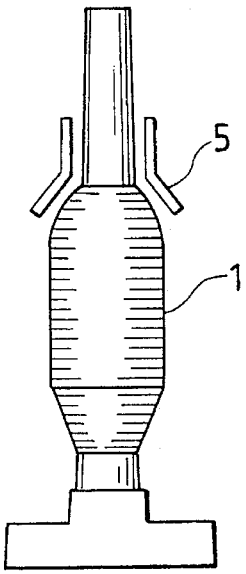

FIG. 3A shows an example in which the cylinder 5 is formed cylindrical throughout the length of the bobbin 1 from the top to the bottom; FIG. 3B shows an example in which the upper portion of the cylinder 5 is constricted in a flare shape in conformity with the shape of the chase portion 15*a* of the bobbin 1; FIG. 3C shows an example in which the cylinder 5 is composed of a stationary cylindrical portion 5*a* provided to cover the outer periphery of the bobbin 1 and an inverted flare-shaped, movable cylindrical portion 5*b* fitted in the stationary cylindrical portion 5*a* and movable vertically in accordance with the height of the chase portion 15*a*; and FIG. 3D shows an example in which the cylinder 5 is formed vertically movably in in an inverted flare shape.

Figure 3E:
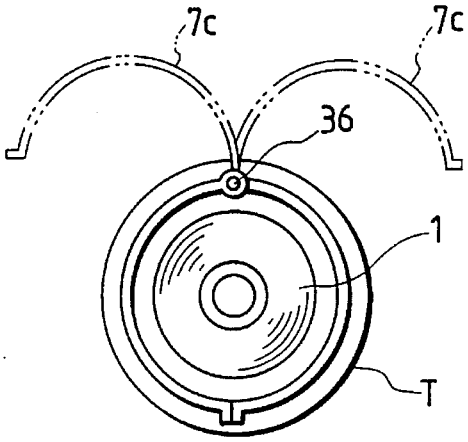

Further, FIG. 3E shows an example in which the cylinder 5 is split into cylindrical halves 7*c*, 7*c*, which are interconnected for opening and closing motion through a pin 36. In this case, the cylindrical halves 7*c*, 7*c* may be constituted by the stationary cylindrical portion 5*a* shown in FIG. 3C or by the whole of the cylinder 5 shown in FIGS. 3A or 3B. For such opening/closing type there is provided an opening/closing mechanism instead of the vertically moving mechanism for the cylinder 5.

Figure 4A:
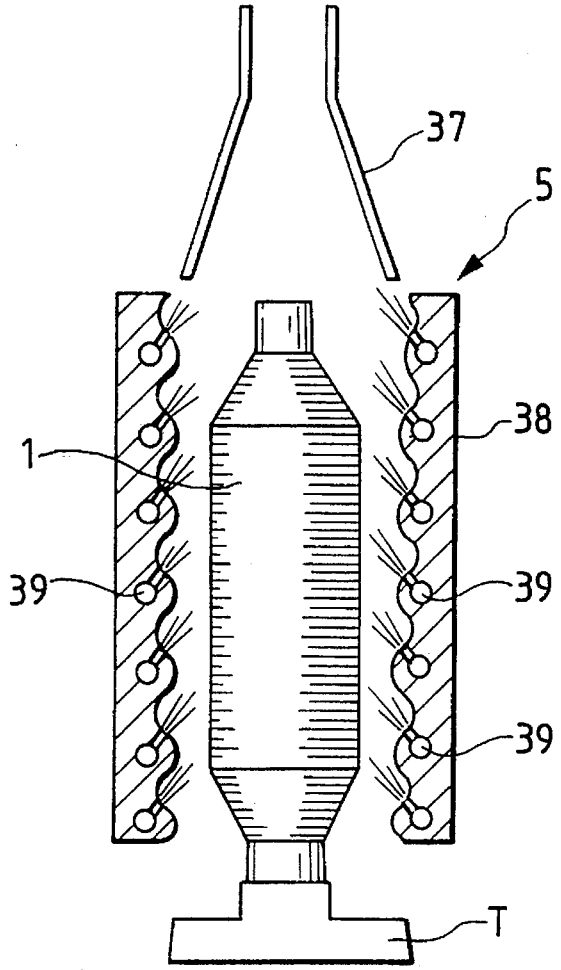
FIGS. 4A to 4C are diagrams showing still further examples of a cylinder.
Figure 4B:
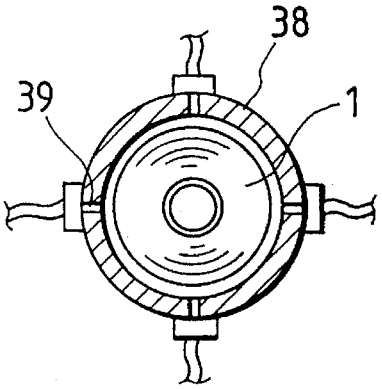
Figure 4C:
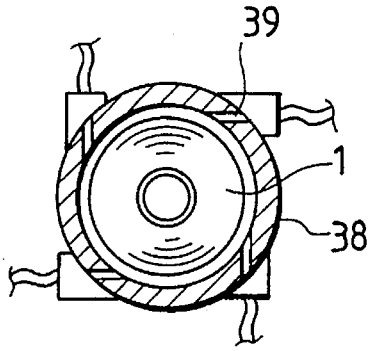

FIG. 4A shows a further example of the cylinder 5, in which the cylinder 5 is composed of a cylindrical portion 38 covering the outer periphery of the bobbin 1 and an upper, flare-shaped, movable cylindrical portion 37 and in which a large number of nozzles 39 are provided in the inner periphery of the cylindrical portion 38, the nozzles 39 ejecting blast air obliquely upward as indicated by the line in the figure to promote the suction of the yarn on the bobbin surface into the movable cylindrical portion 7. As shown in FIGS. 4B and 4C, the blast air from the nozzles 39 may be directed perpendicularly or tangentially with respect to the yarn layers.

Figure 5:
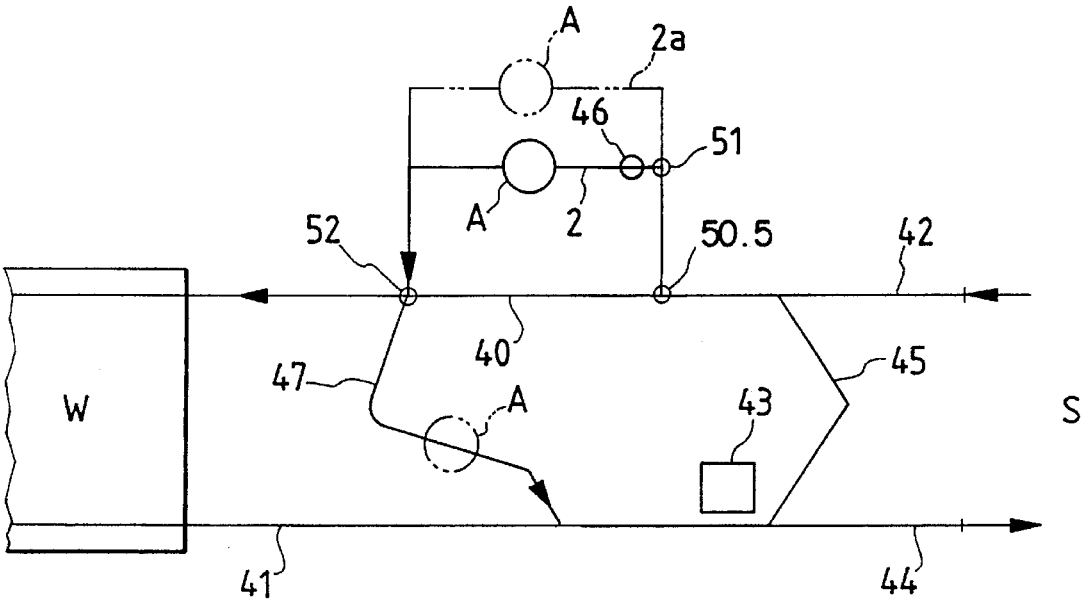
FIG. 5 is a diagram showing an example in which the yarn end finding apparatus of the present invention is incorporated in a winder.

FIG. 5 shows an example in which the yarn end finding apparatus A of the present invention is incorporated in an automatic winder W.

In FIG. 5, the numeral 40 denotes a spinning bobbin conveyance line for feeding a spinning bobbin to the winder W, and numeral 41 denotes a bobbin discharge line. A spinning bobbin from the spinning frame is fed in an upright state on the tray T from a spinning bobbin feed line 42. On the other hand, an empty bobbin which has been conveyed along the bobbin discharge line 41 passes a stripper 43, in which stripper the remaining yarn is stripped off from the bobbin. Thereafter, the empty bobbin is fed to a spinning frame (not shown) through an empty bobbin feed line 44. A partial bobbin which has been conveyed along the bobbin discharge line 41 is returned as it is to the spinning bobbin conveyance line 40 through a return line 45 without being subjected to the stripping operation in the stripper 43.

Separately connected to the spinning bobbin conveyance line 40 is a conveyance path 2 for yarn end finding, and the yarn end finding apparatus A is provided in the conveyance path 2. In this case, a rotary cutter 46 for cutting the bottom bunch of a bottom bunch type bobbin and unwinding the yarn from the bobbin is disposed upstream of the yarn end finding apparatus A. In the case of a top bunch type bobbin, a searcher is used in place of the rotary cutter 46.

At a branch portion between the spinning bobbin conveyance line 40 and the conveyance path 2 for the yarn end finding, a distributing device 51.5 which judges a bobbin to be processed to a yarn end finding operation or one not to be processed, introduces the bobbin to be processed to the yarn end finding operation to the conveyance path 2, and guides the bobbin not to be processed to the spinning bobbin conveyance line 40.

In accordance with the yarn end finding capability of the yarn end finding apparatus A, an auxiliary conveyance path **2*a* may be connected in parallel with the conveyance path 2 indicated by a solid line, as shown by a dash-double dot line in the figure, and the apparatus A may also be provided in the conveyance path 2*a*. In this case, a distributing device 51 is provided at a branch portion between the conveyance paths 2 and 2*a*. The distributing device 51 judges whether a bobbin has a top bunch or a bottom bunch, or judges whether a bobbin is a partial bobbin or a bobbin failed in yarn end finding operation. A bobbin having a top or bottom bunch is fed to the conveyance path 2 shown by a solid line and a yarn end finding operation is done by a yarn end finding apparatus disposed on the conveyance path 2, while a partial bobbin or a bobbin which has been unsuccessful in yarn end finding may be fed to the auxiliary conveyance path 2*a* and subjected to the yarn end finding operation in the apparatus A disposed in the path 2*a*. It may be possible that bobbins are distributed by the distributing device 51** according to the yarn kind wound on the bobbin.

The bobbin which has thus been subjected to the yarn end finding operation is returned to the spinning bobbin conveyance line 40 and is fed to the winder W, while the bobbin which has been unsuccessful in yarn end finding is returned to the empty bobbin discharge line 41 through a by-pass line 47 and is again subjected to the yarn end finding operation as is the case with a partial bobbin. The yarn end finding apparatus A of the present invention may be disposed also in the by-pass line 47. In this case, a distributing device 52 which judges a bobbin which has been unsuccessful in yarn end finding and guides the unsuccessful bobbin to the by-pass line 47, is disposed at a branch portion between the spinning bobbin conveyance line 40 and the by-pass line 47.

Figure 6:
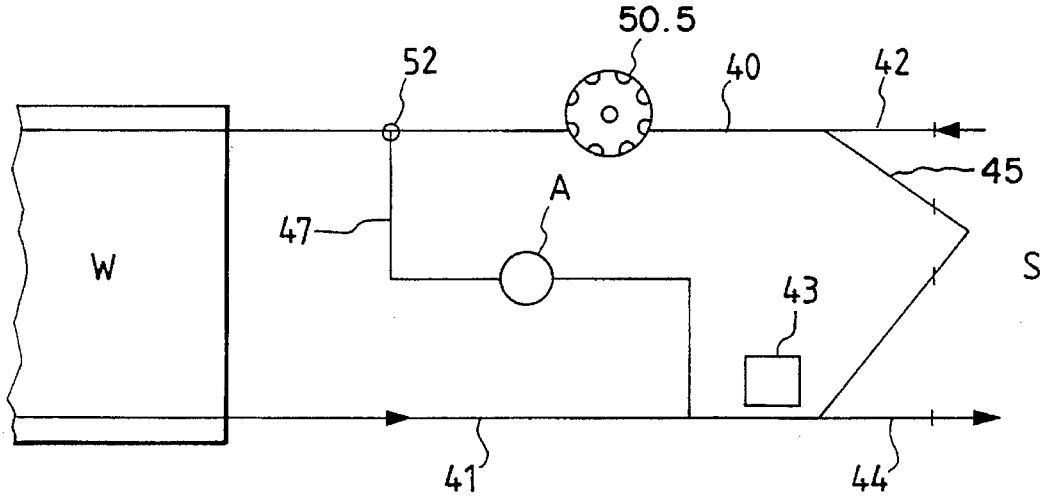
FIG. 6 is a diagram showing an example in which the yarn end finding apparatus of the invention is incorporated in a winder together with an existing yarn end finding apparatus.

FIG. 6 shows an example in which the yarn end finding apparatus A of the present invention is incorporated in an existing yarn end finding apparatus (for example the apparatus disclosed in Japanese Patent Publication No. 5746/93). In the same figure, the numeral 40 denotes a spinning bobbin conveyance line, numeral 41 denotes an empty bobbin discharge line, numeral 42 denotes a spinning bobbin feed line, 43 a stripper, 44 an empty bobbin feed line, 45 a return line and 47 a by-pass line, 52 a distributing device. The yarn end finding apparatus A of the present invention is mounted in the by-pass line 47 to perform the yarn end finding operation for a bobbin which has been unsuccessful in yarn end finding. An auxiliary yarn end finding apparatus according to the invention may be provided within the winder W. The cylinder member or the air current control means may be provided with a cutter. There may be provided means for rotating each bobbin in the yarn end finding position P. It is optional whether the conveyance of the tray T is to be done using a round belt or a flat belt.

The embodiment in which the bobbin pressing lever 29 being turnable in horizontal direction is used as the pressing means, is disclosed. However, any other bobbin pressing means which can prevent a bobbin from coming off a tray other than the lever, for example, a device for gripping a bobbin at both sides of the bobbin or a device for chucking a bobbin, can be applied to. It is desirable to dispose at an upstream side of the yarn end finding position a detecting device which can detect whether a bobbin erected on a tray is in a floating condition. A yarn end finding apparatus is not operated when the bobbin is detected to be one in the floating condition. According to such a construction, it can be prevented that a bobbin comes off a tray by the suction stream at the yarn end finding position.

According to the present invention, as set forth above, the yarn end finding apparatus has the following advantages.

(1) Since the whole or part of the yarn layers of a bobbin to be subjected to the yarn end finding operation are covered with the air current control member and a suction air current is generated in the air current control member by means of an air current generating means, the yarn end finding operation can be done easily and positively in that position.

(2) Both S- and Z-twist bobbins can be subjected to the yarn end finding operation.

(3) Even bobbins different in length and those different in diameter (different in shape) can be subjected to the yarn end finding operation.

(4) The yarn end finding operation is applicable to even partial, small- and skinny bobbins.

(5) It is also possible to effect yarn end finding for a chase cut bobbin and a bobbin with an additional winding.

(6) Both top and bottom bunch type bobbins can be subjected to the yarn end finding operation.

(7) The working efficiency of a finding yarn end may be increased when a sensor for detecting a yarn end finding operation is provided.

(8) A bobbin can be stably processed to a yarn end finding operation because a lower end portion of the bobbin is held by a bobbin pressing means and strong air stream can be applied to the bobbin.

(9) The working efficiency of a yarn end finding operation can be increased when a conveyance path for yarn end finding, which is provided with a yarn end finding apparatus, is branched from a midway portion of a spinning bobbin conveyance line, and a distributing device is so provided at the branching portion that only bobbins for processing a yarn end finding operation are fed to the conveyance path for yarn end finding.

Another embodiment of a yarn end finding apparatus, whereby a length of a yarn end drawn out may be properly determined regardless of a length of a bobbin, will be described hereinafter.

According to this embodiment, there is provided a yarn end finding device including an air current generating means, an air current control member for controlling an air current generated by the air current generating means in such a manner that the air current flows along the surface of yarn layers of a bobbin, the air current control member being formed so as to be movable forward and backward with respect to a position in which it surrounds part or the whole of the bobbin, and a cutter means for cutting yarn which has been drawn out from the yarn layers by virtue of the air current, the cutter means being mounted to the air current control member.

The embodiment of the present invention will be described hereinafter with reference to the accompanying drawings.

Figure 7A:
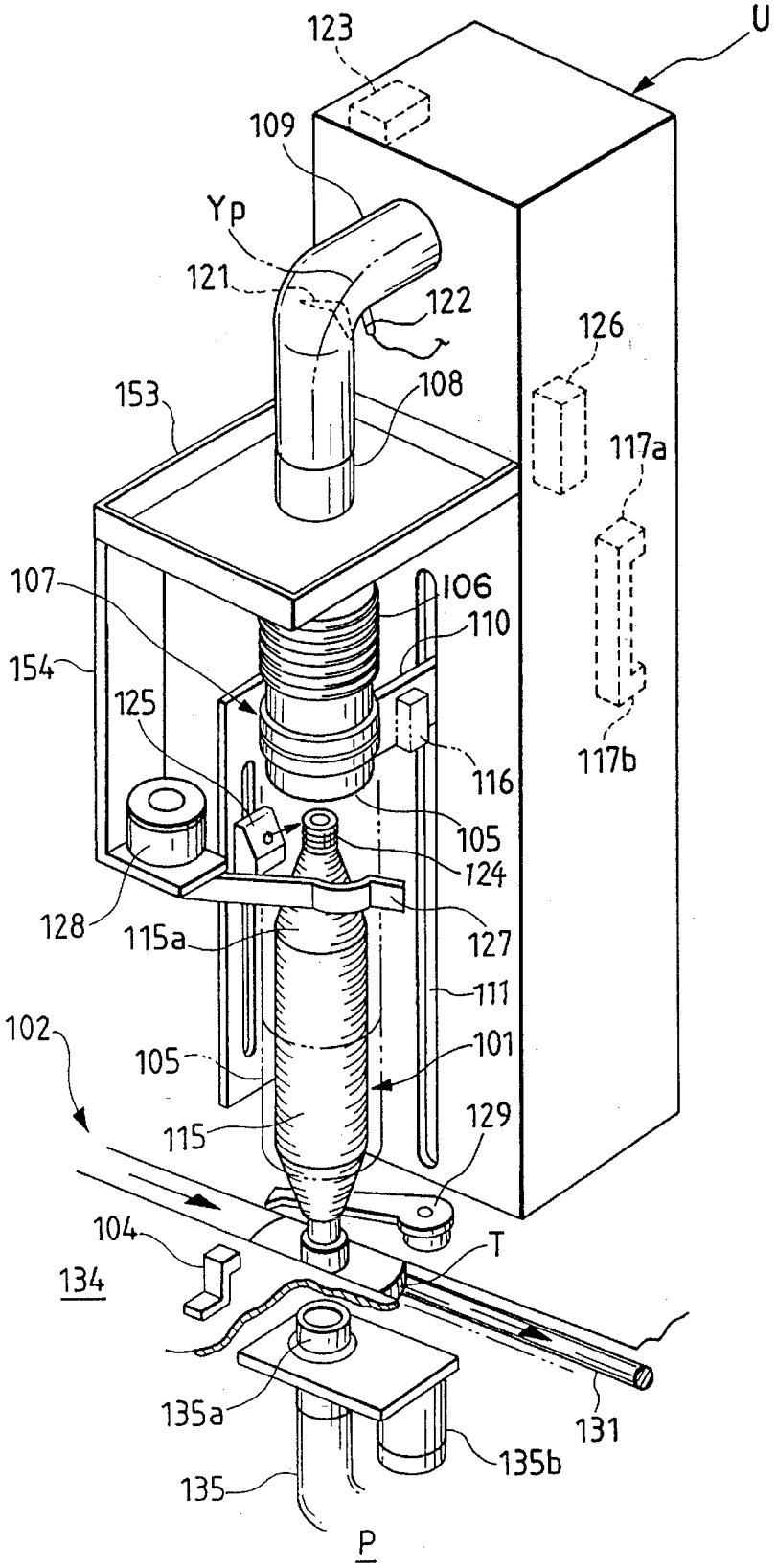
FIG. 7A is a perspective view illustrating another embodiment of a yarn end finding apparatus of the present invention and FIG. 7B is a sectional view of a part of the apparatus.
Figure 7B:
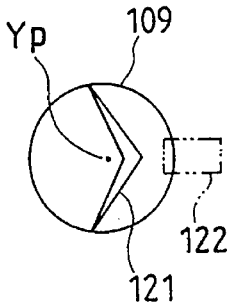
Figure 8:
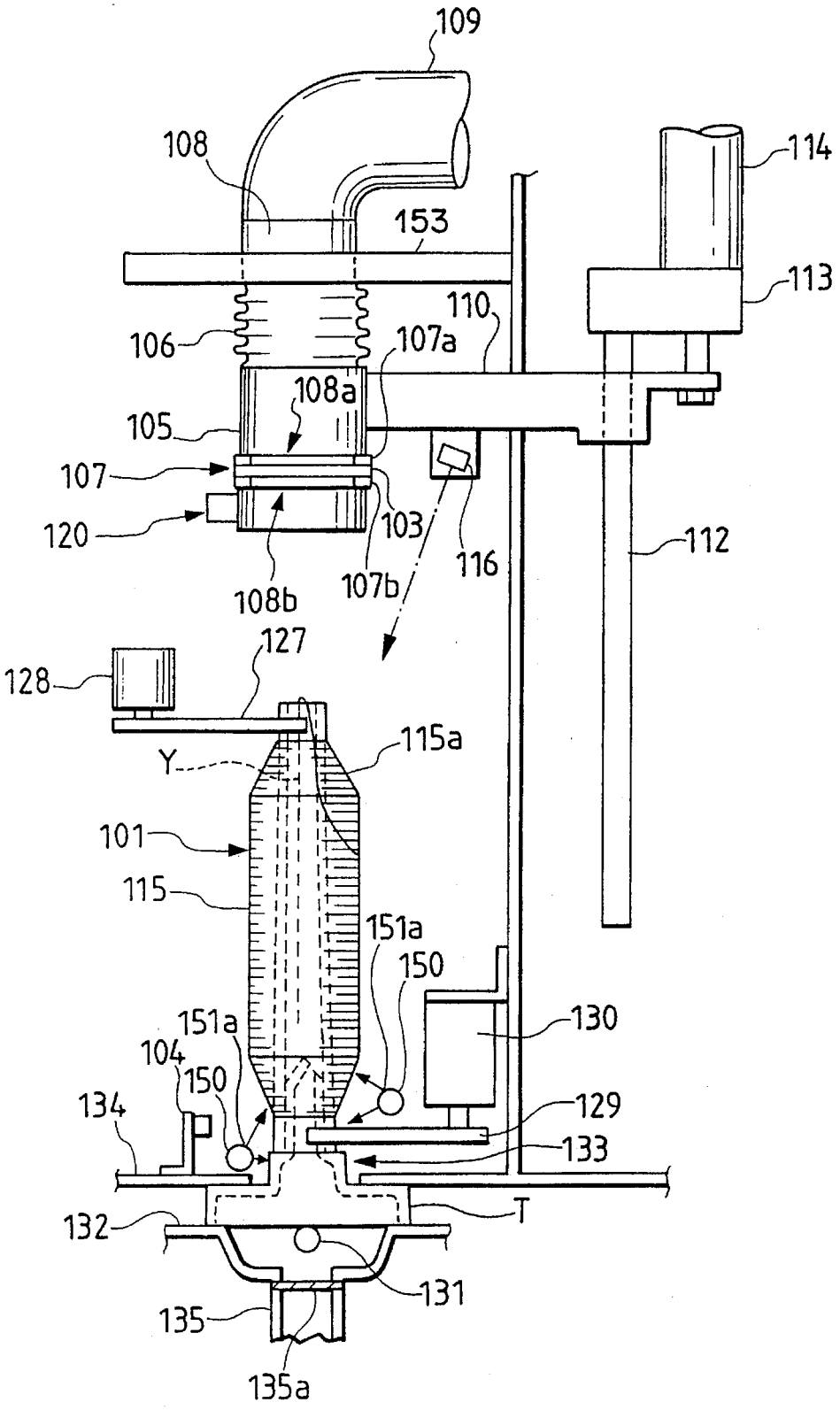
FIG. 8 is a side view of FIG. 7A.

FIGS. 7 and 8 illustrate a yarn end finding device according to another embodiment of the present invention. The yarn end finding device mainly comprises a suction pipe 109 disposed in a predetermined position (yarn end finding position P) of a yarn end finding conveyance path 102 and serving as an air current generating means, a cylinder (air current control member) 105 for controlling air sucked by the suction pipe 109 so as to flow along the surface of yarn layers 115 of a bobbin 101, and a shutter-cutter 107 mounted to the cylinder 105 and serving as a cutter means for cutting yarn which has been drawn out from the yarn layers 115 by virtue of suction air.

The yarn end finding conveyance path 102, which is for conveying the bobbin 101 in an upright state on a tray T for conveyance, comprises a round belt 131 which is in contact with the underside of the tray T, bottom guide plates 132 disposed along both sides of the round belt 131 to bear and guide both sides of the bottom of the tray T, and upper guide plates 134 for restricting and guiding a peg portion 133 of the tray T. The round belt 131 may be substituted by a flat belt. In the yarn end finding position P are provided a stopper (not shown) for stopping the tray T and a tray sensor 104 for detecting whether the tray T is present or not. On an upstream side of the yarn end finding position P is disposed a discriminator for judging whether the bobbin 101 is rewindable or not in a winder. A bobbin having an extremely small amount of residual yarn, an empty bobbin and an empty tray are judged to be back-winding impossible.

The suction pipe 109 is attached to an upper side face of a yarn end finding device body (housing) U which is erected correspondingly to the yarn end finding position P, and a base end thereof is connected to a suction air source (e.g. pump), while the opposite end thereof is bent downward. The cylinder 105 is connected to the lower end of the suction pipe 109 through a bellows hose 106 and is formed so as to be coaxial with the bobbin 101 which has stopped in the yarn end finding position P.

An arm 110 is attached to a side part of the cylinder 105. The arm 110 extends into the device body U through a vertical slit 111 and is supported vertically movably by means of a vertical guide rod 112 which is fixed within the device body U. An extending end of the arm 110 is mounted to a piston rod of an air cylinder 114 for vertical movement which cylinder is mounted to a fixing plate 113 for the guide rod 112. The air cylinder 114 is adapted to extend and withdraw in accordance with ON-OFF operation of a solenoid valve 117*a* for ascent and a solenoid valve 117*b* for descent which valves are provided in suitable positions of an air supply hose (not shown), whereby the cylinder 105 is moved up and down through the arm 110.

Figure 9:
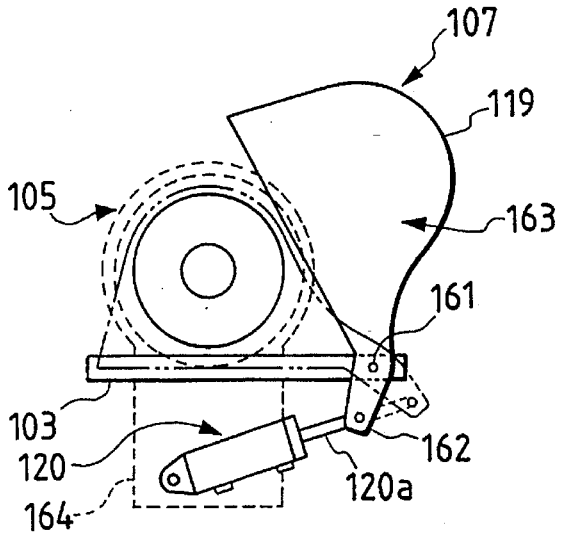
FIG. 9 is a plan view showing a cutting device of the apparatus of FIG. 7A.

The shutter-cutter 107 comprises an upper plate 107*a* and a lower plate 107*b* both mounted to the cylinder 105 in intermediate positions, as well as a fixed cutter 103 and a movable cutter 119 serving also as a shutter both mounted between the upper and lower plates 107*a*, 107*b*, with holes 108*a* and 108*b* being formed in the upper plate 107*a* and lower plate 107*b*, respectively, the holes 108*a* and 108*b* being in communication with the suction pipe 109. As shown in FIG. 9, the movable cutter 119 is generally in a semicircular shape larger than the holes 108*a* and 108*b*, and one end thereof is supported at one end of the fixed cutter 103 pivotably with a vertical pin 161. One end of the movable cutter 119 extends in a suitably bent form, and to the front end of its extending portion, indicated at 162, is connected a rod 120*a* of an actuator 120 for the shutter. By extension of the rod 120*a*, the movable cutter 119 is moved pivotally into mesh with the fixed cutter 103 to cut yarn which has entered the cylinder 105, and at the same time the holes 108*a* and 108*b* are closed with a face portion 163 of the movable cutter 119. On the other hand, by withdrawing the rod 120*a*, the movable cutter 119 is opened to a larger extent than the outside diameter of the bobbin 101. The actuator 120 for the shutter is secured to a support plate 164 formed on the cylinder 105. Further, on the in-corner side of the bent portion in the suction pipe 109 is formed a V-shaped guide 121 for guiding yarn end which has been sucked to a predetermined position, and a yarn end sensor 122 is disposed in a position facing a yarn path Yp [see FIG. 7B]. In accordance with an output provided from the sensor 122 there is operated a solenoid valve 123 for the shutter-cutter which valve is for driving the actuator 120 for the shutter.

Figure 10:
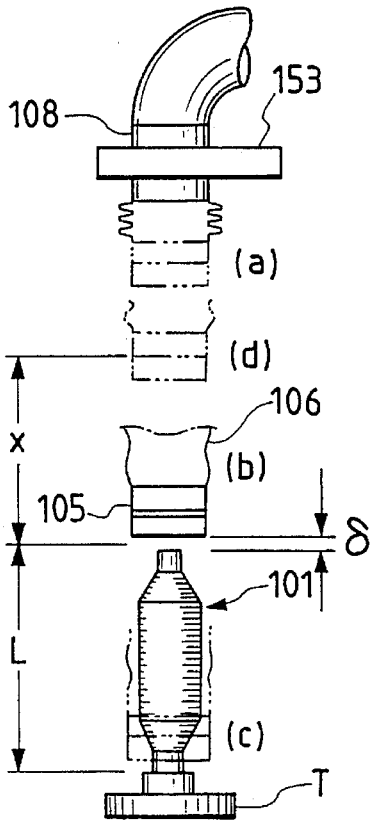
FIG. 10 is a side view for explaining the operation of the device of FIG. 9.

As shown in FIG. 10, the cylinder 105 is adapted to move down from a stand-by position (a) corresponding to the upper end of the stroke to a position (b) close to the head of the bobbin 101 and further to a position (c) corresponding to the lower end of the bobbin, and stop in a cutting position (d) between the stand-by position (a) and the close-to-head position (b). The cutting position (d) is set so that the distance, x, from the head of the bobbin 101 to the shutter-cutter 107 is shorter than the length, L, of the bobbin 101 (L>x). For example, if the bobbin length, L, is 180 mm, the distance, x, is set at 140 mm. That is, the distance, x, should be set as a constant length of the yarn end inserted into the bore of the bobbin. This distance x may be changed according to the length L of the bobbin 101. Furthermore, it may be possible that the distance x is controlled in accordance with the length of bobbins which are transported to the yarn end finding position. In the close-to-head position (b), the distance, δ, between the lower end of the cylinder 105 and the upper end of the bobbin head may be set at a value of 10 to 15 mm. For example, a bobbin sensor 116 for detecting a chase portion 115*a* of yarn layers 115 of the bobbin 101 may be attached to the arm 110, and on the basis of detected values provided from the sensor 116 there may be determined the distances x and δ.

An output pipe 108 as a connection between the bellows hose 106 and the suction pipe 109 is supported by a bracket 153 which is attached to the device body U. From the bracket 153 is suspended an elongated plate 154, and at the lower end of the elongated plate 154 are provided both a head pressing lever 127 for pressing yarn sucked by the suction pipe 109 onto the bobbin 101 and an actuator 128 for the lever 127. The head pressing lever 127 is moved pivotally into abutment with and away from the head of the bobbin 101 by means of the actuator 128. On the yarn end finding device body U side there is provided a bunch removing blast nozzle 125 for removing top bunch 124 on top of the bobbin 101 and is also provided a solenoid valve 126 for blast which valve makes and breaks the supply of air for the blast nozzle 125. The blast nozzle 125 is used only for the bobbin 101 of top bunch 124 and is not used for a bottom bunch type bobbin.

On the other hand, in the yarn end finding position P of the yarn end finding conveyance path 102 there is disposed a bobbin pressing lever 129 for pressing a yarn-free lower portion of the bobbin 101 to prevent dislodgement of the bobbin from the tray T in the yarn end finding operation for the bobbin, particularly when unwinding yarn from the bobbin 101 with descent of the cylinder 105, and is also disposed an actuator 130 for the lever 129. Below the bottom guide plates 132 in the yarn end finding position P is disposed a suction pipe 135 for sucking a constant length of yarn Y into the bore of the bobbin 101 after being cut into a constant length with the shutter-cutter 107. An upper-end opening of the suction pipe 135 faces the underside center of the tray T located in the yarn end finding position P. A top opening suction shutter 135*a* is disposed in a suitable position of the suction pipe 135. The shutter 135*a* is opened and closed with a solenoid 135*b*. On the upper guide plates 134 in the yarn end finding position P are provided yarn blow-off nozzles 150 in both side positions with respect to the bobbin 101. Each nozzle 150 is formed with two blast air blow-off holes 151*a* in obliquely upward and obliquely downward positions with respect to the bobbin 101. By virtue of the blast air from each nozzle 150, for example the yarn hanging down from the yarn layers 115 of the bobbin 101 is blown off from the bobbin pressing range of the bobbin pressing lever 129.

The operation of this embodiment will be described below.

Before the tray T reaches the yarn end finding position P along the yarn end finding conveyance path 102, it is judged by the discriminator whether the bobbin is rewindable or not in a winder, that is, whether the yarn end finding operation is necessary or not. When the yarn end finding operation is not needed, for example in the case of a bobbin having an extremely small amount of residual yarn, an empty bobbin, or an empty tray with no bobbin thereon, the yarn end finding operation is not performed in the yarn end finding device and the bobbin passes the yarn end finding position P. On the other hand, when the yarn end finding operation is needed, for example in the case of a spinning bobbin from a spinning frame or a bobbin having residual yarn (partial bobbin or skinny bobbin) discharged and recycled from the winder, the following yarn end finding operation is performed. Further, in the case of a bottom bunch type full bobbin, the bottom bunch is unwound in a bottom bunch cutting station located upstream of the yarn end finding position P.

When the tray T has been conveyed up to the yarn end finding position P, it is stopped by means of the stopper. Once the tray sensor 104 detects the tray T, blast air is ejected from the yarn blow-off nozzles 150 and subsequently the bobbin pressing lever 129 (actuator 130) operates, so that the lower portion of the bobbin 101 is pressed by the front end portion of the bobbin pressing lever 129. In this state, there is no fear of the bobbin 101 coming off the tray T even if suction force is exerted on the bobbin. Since air is blown out from the nozzles 150 before the bobbin pressing lever 129 presses the bobbin 101, the yarn end is prevented from being gripped between the bobbin pressing lever 129 and the bobbin 101, that is, the yarn end finding operation is prevented from becoming unsuccessful.

Upon operation of the bobbin pressing lever 129, the actuator 120 operates, the shutter-cutter 107 opens, the suction pipe 109 and the cylinder 105 come into communication with each other, and an air current (suction force) is generated which flows upward into the cylinder 105 along the yarn layer surface of the bobbin 101. Once a shutter-cutter 107 begins to operate, the cylinder 105 begins to move down after the lapse of a short time. With descent of the cylinder 105, the cylinder and the bobbin 101 approach each other gradually, so that the air current working on the yarn layers 105 is strengthened. When the cylinder 105 has moved down to the lower end of its stroke, namely, to the position (c) in which it surrounds substantially the whole of the bobbin 101, the cylinder then begins to move upward. Before the cylinder 105 reaches the position (b) close to the bobbin head, the yarn end is sucked up into the suction pipe 109 nearly completely if the bobbin is the ordinary type of full bobbin. But there also is the case where fluff entanglement occurs and the yarn end is stuck on the surface of the yarn layers 115. In this case, the sensor 122 does not detect the yarn end and therefore the cylinder 105 again performs its downward movement. The descent and ascent of the cylinder 105 are repeated with a total of three times as a limit. When the yarn end is not detected by the sensor 122 even after repetition of such vertical movement, the stopper is released and the tray T is moved away from the yarn end finding position P. The number of times of such repetition is not limited to three. It may be one or four or more. During the period from the time when the cylinder 105 begins to move up until when it begins to move down next, the ejection of blast air from the yarn blow-off nozzles 150 is discontinued. This can be done easily by the reception of signals from the solenoid valves 117*a* and 117*b*.

When the sensor 122 detects the yarn end, the cylinder 105 rises up to the cutting position (d) and then stops. In the case of handling one kind of bobbins 101 or in the case where the bobbins to be handled are not so different in length, the yarn end finding device may be designed such that the upper-limit position of the cylinder 105 is set to the cutting position (d) and that once the yarn end sensor 122 detects the yarn end just after the action of suction air, the descent of the cylinder 105 is not performed. When the cylinder 105 stops, the head pressing lever 127 operates and comes into abutment with the head portion of the bobbin 101 to press the yarn extending between the bobbin 101 and the suction pipe 109, thereby preventing the yarn from being drawn out excessively from the yarn layers 115. Modification may be made so that the head pressing lever 127 operates when the cylinder 105 has ascended to a predetermined height prior to reaching the cutting position (d), if only the interference between the cylinder 105 and the head pressing lever 127 is avoided. Upon operation of the actuator 128, the solenoid 135*b* also operates to open the top opening suction shutter 135*a*, so that a downward suction force is exerted on the bore of the bobbin 101.

Now, the actuator 120 operates to close the shutter-cutter 107, so that the yarn which is sucked into the suction pipe 109 from the bobbin 101 is cut by the shutter-cutter 107, and the suction air is shut off. After the cutting, the yarn end extending from the bobbin 101 is sucked into the bore of the bobbin by the suction force of the suction pipe 135. Since the distance, x, from the bobbin 101 to the shutter-cutter 107 is set shorter than the length, L, of the bobbin, there is not possibility that the yarn end Y sucked into the bobbin 101 will pass the tray T and extend up to the bottom guide plates 132.

Subsequently, the actuator 128 operates, the head pressing lever 127 returns to its original position, the bobbin pressing lever 129 also returns to its original position, and the suction shutter 135*a* closes. Thereafter, the stopper which stops the tray T is released, resulting in that the tray T is moved away from the yarn end finding position P and is fed through the yarn end finding conveyance path to each take-up unit in the finder.

In the case of a top bunch type full bobbin, after opening of the shutter-cutter 107, blast air is ejected from the bunch removing blast nozzle 125 toward the bunch portion of the bobbin 101 to unwind the top bunch. Subsequently, the cylinder 105 begins to move down, followed by the same operation as in the case of a bottom bunch.

Thus, since the yarn layers 115 of the bobbin 101 to be subjected to yarn end finding operation is covered with the cylinder 105 and suction air current is generated by supplying suction air to the cylinder 105, a yarn end can be drawn out by virtue of a strong air current working on the surface of the yarn layers 115, and the yarn end finding operation for the bobbin 101 can be done more easily, efficiently and positively in a single stop of the tray. Besides, the device can be constituted in a compact form, whereby the reduction of space and of cost can be attained. Moreover, since the shutter-cutter 107 is mounted in the cylinder 105 to cut the drawn-out yarn in the cutting position (d), an appropriate length of yarn end to be inserted into the bore of the bobbin 101 can be ensured irrespective of the height of the bobbin 101, for example even in the case of a bobbin length shorter than the standard bobbin length. That is, it is possible to prevent such an accident as extending of yarn end from the tray T into entanglement with the conveyance system thereby causing stop of conveyance.

According to the embodiment of the present invention, as set forth above, the following excellent effect is attained.

The whole or part of yarn layers of a bobbin to be subjected to the yarn end finding operation is covered with the air current control member and a suction air current is generated by the air current generating means, further, a cutter means is provided in the air current control member. Consequently, a compact construction is attained and in the position of the yarn end finding device there can be performed the yarn end finding operation positively in a simple manner to afford a yarn end of a predetermined length. If the bobbins are different in lengths thereof, the yarn end drawn out from the bobbin may be cut in the length being appropriate to the length of the bobbin.

What is claimed is:

1. In a yarn end finding operation using a yarn end finding apparatus having a yarn feeding means for feeding yarn from a bobbin having an outermost layer of yarn with a yarn end to a winder, said yarn feeding means comprising:

a means for generating air current;

an air current control means for controlling an air current generated by said air current generating means by directing said air current to flow along a surface of said outermost layer of yarn of said bobbin, said air current control means being a hollow tube-like cylinder of various configurations disposed on said yarn finding apparatus so as to be movable up and down with respect to a yarn end finding position in which said bobbin is located during said yarn end finding operation and wherein said cylinder is capable of surrounding said bobbin at least partially depending on said configuration of said cylinder;

a yarn end sensor means for detecting said yarn end drawn out from said outermost layer of yarn of said bobbin;

a means for dually controlling said air current control means by stopping said air current control means from moving down over said bobbin located on said yarn end finding position to at least partially surround said bobbin when said yarn end sensor has detected said yarn end and by repeatedly moving said air current control means up and down a predetermined number of times over said yarn end finding position to at least partially surround said bobbin, depending on said configuration of said cylinder, until said yarn end sensor detects said yarn end has been drawn out from said outermost layer of yarn of said bobbin; and a cutter means for cutting a length of yarn from said yarn end which has been drawn out from said layers of yarn by said air current wherein said cutter means is mounted to said air current control means.

2. A yarn end finding apparatus as claimed in claim 1, further comprising a bobbin pressing means for pressing a lower end portion of said bobbin into a recess of a peg portion of a tray.

3. A yarn end finding apparatus as claimed in claim 2, further comprising a bobbin detecting sensor means for detecting a chase portion of said bobbin to determine whether to move said air current control means up and down for said predetermined number of times.

4. A method of operating a yarn end feeding means of a yarn end finding aparatus in a yarn end finding operation comprising the method steps of:

providing a yarn end finding apparatus with a yarn feeding means for feeding yarn from a bobbin having an outermost layer with a yarn end to a winder wherein said yarn feeding means includes an air current generating means for generating air current, an air current control means for directing said air current generated by said air current generating means to flow along a surface of said outermost layer of yarn of said bobbin, said air current control means being a hollow tube-like cylinder having an outer configuration disposed on said yarn end finding apparatus so as to be movable up and down to at least partially surround said bobbin conveyed upright on a tray to a yarn end finding position during said yarn end finding operation, a yarn end finding sensor means for detecting said yarn end drawn out from said outermost layer of yarn of said bobbin, and a means for dually controlling said air current control means by stopping said air current control means from moving down over said bobbin located on said yarn end finding position to at least partially surround said bobbin when said yarn end sensor has detected said yarn end and by repeatedly moving said air current control means up and down a predetermined number of times over said yarn end finding position to at least partially surround said bobbin depending on said configuration of said cylinder, until said yarn end sensor detects said yarn end has been drawn out from said outermost layer of yarn of said bobbin and a cutter means for cutting a length of yarn from said yarn end which has been drawn out from said layers of yarn by said air current wherein said cutter means is mounted to said air current control means;

generating said air current to flow toward a central longitudinal axis of said cylinder; and determining whether said yarn end finding sensor means has detected said yarn end.

5. The method of operating a yarn feeding means as in claim 4, further comprising the method step of determining whether said bobbin has a top bunch or a bottom bunch.

6. The method of operating a yarn feeding means as in claim 5, further comprising the method step of determining that said bobbin has a top bunch so as to eject blast air from a bunch removing blast nozzle toward said top bunch for a predetermined period of time.

7. The method of operating a yarn feeding means as in claim 5, further comprising the method step of determining that said bobbin has a bottom bunch so as to begin said cylinder's downward movement, if said yarn has not been detected.

8. The method of operating a yarn feeding means as in claim 7, further comprising the method step of determining that said yarn end finding sensor has sensed said yarn end to thus prevent downward movement of said cylinder over said bobbin.

9. The method of operating a yarn feeding means as in claim 8, further comprising the method step of moving said cylinder downwardly over said bobbin thus, causing said cylinder and said bobbin to approach each other gradually and thus, enhancing said air current being blown on said outermost layers of said yarn of said bobbin.

10. The method of operating a yarn feeding means as in claim 9, further comprising the method step of sensing said yarn end with said yarn end finding sensor means during downward movement of said cylinder thus, causing said cylinder to immediately rise.

11. The method of operating a yarn feeding means as in claim 10, further comprising the method step of sensing said yarn end with said yarn end finding sensor means during downward movement of said cylinder thus, causing said cylinder to continue to move down over said bobbin to substantially surround said bobbin.

12. The method of operating a yarn feeding means as in claim 7, further comprising the method step of reaching said an end of said cylinder's downward movement over said bobbin thus, causing said cylinder to begin to move upwards.

13. The method of operating a yarn feeding means as in claim 12, further comprising ending said cylinder's upward movement so that said yarn end is not sensed by said yarn end finding sensor means, in order for said cylinder to again descend over said bobbin for a predetermined number of times.

14. The method of operating a yarn feeding means as in claim 13, further comprising the method step of failing to sense said yarn end by said yarn end finding sensor means after said cylinder has been moved up and down said predetermined number of times, and releasing a stopper in order for said tray conveying said bobbin to be conveyed away from said yarn end finding position.

15. The method of operating a yarn feeding means as in claim 14, further comprising preventing ejection of blast air from a yarn blow-off nozzle during a period of time between when said cylinder starts ascending and a time when said cylinder starts descending again.

16. In a yarn end finding operation using a yarn end finding apparatus having a yarn feeding means for feeding yarn from a bobbin, having an outermost layer of yarn with a yarn end, to a winder, said yarn feeding means comprising:

a means for generating an air current;

a means for controlling said air current, once generated, by directing said air current to flow along a surface of said outermost layer of yarn of said bobbin, said air current control means located on said yarn end finding apparatus so that said air current control means moves downwardly with respect to a yarn end finding position into a position at least partially surrounding said bobbin and said air current control means moves upwardly with respect to a yarn end finding position into a position entirely above said bobbin;

a yarn end sensor means for detecting said yarn end drawn out from said outermost layer of yarn of said bobbin; and a means for dually functioning to control said air current control means by stopping said air current control means from moving downwardly over said bobbin located on said yarn end finding position when said yarn end sensor has detected that said yarn end has been drawn out and by repeatedly moving said air current control means downwardly and upwardly a predetermined number of times over said yarn end finding position to either partially or entirely surround said bobbin until said yarn end sensor detects said yarn end has been drawn out from said outermost layer of yarn of said bobbin.

17. In a yarn end finding operation according to claim 16, wherein said means for generating said air current generates said air current prior to said air current control means begins to move downwardly over said bobbin, and a control means for controlling both said air current control means and said air current generating means by stopping said air current control means from moving downwardly over said bobbin when said yarn end sensor means detects said yarn end due to said air current being generated by said air current generating means.

* * * * *